US009142155B2

(12) United States Patent
Jang et al.

(10) Patent No.: US 9,142,155 B2
(45) Date of Patent: Sep. 22, 2015

(54) DISPLAY DEVICE, SIGNAL CONVERTER FOR THE DISPLAY DEVICE, AND METHOD OF OPERATING THE DISPLAY DEVICE

(71) Applicant: Samsung Display Co., Ltd., Yongin, Gyeonggi-Do (KR)

(72) Inventors: Yong Jun Jang, Yongin-si (KR); Eun Ho Lee, Suwon-si (KR); Nam-Gon Choi, Asan-si (KR); Geun Jeong Park, Daegu (KR); Ji-Woong Jeong, Yongin-si (KR)

(73) Assignee: Samsung Display Co., Ltd. (KR)

( * ) Notice: Subject to any disclaimer, the term of this patent is extended or adjusted under 35 U.S.C. 154(b) by 283 days.

(21) Appl. No.: 13/739,996

(22) Filed: Jan. 11, 2013

(65) Prior Publication Data

US 2014/0035961 A1 Feb. 6, 2014

(30) Foreign Application Priority Data

Aug. 2, 2012 (KR) ..... 10-2012-0084952

(51) Int. Cl.

*G09G 3/20* (2006.01)
*G09G 5/10* (2006.01)
*G09G 5/02* (2006.01)

(52) U.S. Cl.

CPC ..... *G09G 3/2003* (2013.01); *G09G 5/02* (2013.01); *G09G 5/026* (2013.01); *G09G 5/10* (2013.01); *G09G 2340/0457* (2013.01); *G09G 2340/06* (2013.01)

(58) Field of Classification Search

CPC ..... G09G 3/20; G09G 3/2003; G09G 3/2007; G09G 3/2074; G09G 5/02; G09G 5/026; G09G 5/06; G09G 5/10; G09G 2340/04; G09G 2340/0457; G09G 2340/06

USPC ..... 345/690–697

See application file for complete search history.

(56) References Cited

U.S. PATENT DOCUMENTS

| | | | | |
|---|---|---|---|---|
| 5,929,843 | A | 7/1999 | Tanioka | |
| 7,151,517 | B2 | 12/2006 | Lee | |
| 8,031,236 | B2 | 10/2011 | Sa | |
| 8,035,655 | B2 | 10/2011 | Kim et al. | |
| 8,149,196 | B2 | 4/2012 | Baek | |
| 2001/0033260 | A1* | 10/2001 | Nishitani et al. | 345/87 |
| 2007/0211075 | A1* | 9/2007 | Seo et al. | 345/604 |
| 2009/0102769 | A1 | 4/2009 | Kouno et al. | |
| 2010/0253664 | A1 | 10/2010 | Byun et al. | |
| 2011/0292087 | A1 | 12/2011 | Lim | |

FOREIGN PATENT DOCUMENTS

| | | |
|---|---|---|
| JP | 2000-163512 | 6/2000 |
| JP | 2011-232848 | 11/2011 |
| KR | 10-1027567 | 3/2011 |

* cited by examiner

*Primary Examiner* — Nathan Danielsen

(74) *Attorney, Agent, or Firm* — Innovation Counsel LLP

(57) ABSTRACT

A display device includes a display panel including pixels for displaying four colors including a white color. The display device further includes a signal converter for generating four output signals pertaining to the four colors using three input signals pertaining to three non-white colors of the four colors. The display device further includes a signal processor for processing the output signals to generate data signals and to provide the data signals to the display panel for the pixels to display an image. The signal converter includes at least one adder and a plurality of bit shifters for calculating a white-signal candidate using signals related to the input signals. The signal converter may determine a white-related output signal of the output signals using the white-signal candidate.

17 Claims, 7 Drawing Sheets

DISPLAY DEVICE, SIGNAL CONVERTER FOR THE DISPLAY DEVICE, AND METHOD OF OPERATING THE DISPLAY DEVICE

CROSS-REFERENCE TO RELATED APPLICATION(S)

This application claims priority to and the benefit of Korean Patent Application No. 10-2012-0084952, filed in the Korean Intellectual Property Office on Aug. 2, 2012, the entire contents of which are incorporated herein by reference.

BACKGROUND OF THE INVENTION (a) Field of the Invention

The present invention relates to a display device and a method of operating the display device.

(b) Description of the Related Art

Flat panel displays, such as organic light emitting diode displays, liquid crystal displays, and electrowetting displays, have been implemented. A flat panel display may include a plurality of pixels arranged in a matrix and emitting lights of three primary colors. A displayed color may result from adding lights of three primary colors emitted from primary-color light-emitting pixels, and the flat panel display may display a desired image by appropriately controlling the luminance of each pixel. Nevertheless, the flat panel display including only primary-color light-emitting pixels may provide images with unsatisfactory luminance.

A four-color display device may include white pixels, for emitting white light, in addition to primary-color light-emitting pixels. The four-color display device may receive input image signals for primary-color light-emitting pixels, for example, red pixels, green pixels, and blue pixels; the four-color display device may generate output image signals for white pixels and the primary-color light-emitting pixels.

The conversion of three-color input image signals into four-color output image signals may require a complicated structure in the display device or may require a substantially long conversion time.

SUMMARY OF THE INVENTION

One or more embodiment of the invention may be related to a display device. The display device may include a display panel that includes a plurality of pixels configured for displaying a first color, a second color, a third color, and a white color. The display device may further include a signal converter configured to generate a set of output signals (which may include a first output signal pertaining to the first color, a second output signal pertaining to the second color, a third output signal pertaining to the third color, and a fourth output signal pertaining to the white color) using a set of input image signals (which may include a first input signal pertaining to the first color, a second input signal pertaining to the second color, and a third input signal pertaining to the third color). The display device may further include a signal processor configured to process the output signals to generate data signals and to provide the data signals to the display panel, thereby causing the pixels to display an image using the data signals. The signal converter may include at least one adder and a plurality of bit shifters configured to calculate a first white-signal candidate using signals related to the first input signal, the second input signal, and the third input signal. The signal converter may be configured to determine the fourth output signal using the first white-signal candidate.

One of the pixels may include a switching element configured to turn on and off based on a gate signal to transmit or not to transmit one of the data signals, wherein the signal processor may include the following elements: a gate driver configured to provide the switching element with the gate signal; a data driver configured to provide the switching element with the one of the data signals; and a signal controller configured to control the gate driver and the data driver, to process the output image signals for generating processed image signals, and to output the processed image signals to the data driver, and wherein the data driver may convert the processed output image signals into the data signals.

The signal converter may include the following elements: a weighted-signal calculation unit configured to assign respective weights to the first input signal or a first de-gamma signal pertaining to the first input signal, the second input signal or a second de-gamma signal pertaining to the second input signal, and the third input signal or a third de-gamma signal pertaining to the third input signal to generate a first weighted signal, a second weighted signal, and a third weighted signal, respectively; a white-signal candidate calculation unit configured to generate the first white-signal candidate, a second white-signal candidate, and a third white-signal candidate using a first copy of the first weighted signal, a first copy of the second weighted signal, and a first copy of the third weighted signal, the white-signal candidate calculation unit comprising the plurality of bit shifters; a white-signal selection unit configured to select one of the first white-signal candidate, the second white-signal candidate, and the third white-signal candidate as an optimal white signal; a four-color signal calculation unit configured to generate the first output signal or a first pre-gamma signal, the second output signal or a second pre-gamma signal, the third output signal or a third pre-gamma signal, and the fourth output signal or a fourth pre-gamma signal using a delayed copy of the first weighted signal, a delayed copy of the second weighted signal, a delayed copy of the third weighted signal, and the optimal white signal; and a delay unit configured to delay a second copy of the first weighted signal, a second copy of the second weighted signal, and a second copy of the third weighted signal and to output the delayed copy of the first weighted signal, the delayed copy of the second weighted signal, and the delayed copy of the third weighted signal to the four-color signal calculation unit.

In one or more embodiments, the white-signal candidate calculation unit may include the following elements: a first adder configured to add the first, second, and third weighted signals by numbers of times as large as ten times mixing proportions of the first, second, and third colors for obtaining a white color, respectively, and to output a result of the addition to the plurality of bit shifters, each of the mixing proportions being greater than zero and smaller than one; and a second adder configured to add outputs of the plurality of bit shifters to generate the first white candidate signal.

The first adder may perform an operation of $10\times Pr\times Rwgt+10\times Pg\times Gwgt+10\times Pb\times Bwgt$, where Rwgt, Gwgt, and Bwgt are the first, second, and third weighted signals, respectively, Pr, Pg, and Pb are the mixing proportions of the first, second, and third colors, and $Pr+Pg+Pb=1$, and the plurality of bit shifters and the second adder may perform an operation of $1/(b\times 10)$ where b is a natural number.

Each of the plurality of bit shifters may perform an operation corresponding to a term of a polynomial representing $1/(b\times 10)$ in terms of $1/2^n$ where n is a natural number.

The natural number n may be equal to or smaller than a bit number of the first to third input signals added by 1 (one).

In one or more embodiments, the white-signal candidate calculation unit may include a first adder configured to calculate an equivalent sum that is equal to a sum of a first term, a second term, and a third term and configured to provide the equivalent sum to the plurality of bit shifters. The first term may be equal to ten times a value of the first weighted signal multiplied by a first multiplier. The second term may be equal to ten times a value of the second weighted signal multiplied by a second multiplier. The third term may be equal to ten times a value of the third weighted signal multiplied by a third multiplier. Each of the first multiplier, the second multiplier, and the third multiplier may be greater than 0 and smaller than (or less than) 1. The sum of the first multiplier, the second multiplier, and the third multiplier may be equal to 1. The first multiplier, the second multiplier, and the third multiplier may be proportions for mixing the first color, the second color, and the third color to produce the white color. The white-signal candidate calculation unit may further include a second adder configured to perform at least one of adding and subtracting outputs of the plurality of bit shifters to generate the first white-signal candidate.

The first adder may be configured to calculate the equivalent sum by adding one or more adding terms each being equal to the value of the first weighted signal, one or more adding terms each being equal to the value of the second weighted signal, and one or more adding terms each being equal to the value of the third weighted signal. The plurality of bit shifters and the second adder may be configured to perform an operation that approximates a mathematical division operation.

Each of the plurality of bit shifters may be configured to generate a shifted value by shifting a radix point of the equivalent sum by a number of digits such that the plurality of bit shifters may generate a plurality of shifted values. The second adder may be configured to calculate the first white-signal candidate by performing at least one of adding one or more values of a first subset of the shifted values and subtracting one or more values of a second subset of the shifted values.

The number of digits may be equal to or smaller than (or less than) a bit number of the first input signal plus 1. The signal converter may further include the following elements: a de-gamma unit configured to perform one or more de-gamma operations on the first input signal, the second input signal, and the third input signal to generate the first de-gamma signal, the second de-gamma signal, and the third de-gamma signal; and a re-gamma unit configured to perform a gamma operation on the first pre-gamma signal, the second pre-gamma signal, the third pre-gamma signal, and the fourth pre-gamma signal for generating the first output signal, the second output signal, the third output signal, and the fourth output signal.

One more embodiments of the invention may be related to a method of operating a display device. The method may include the following steps: generating a white output image signal based on a first input image signal representing a first color, a second input image signal representing a second color, and a third input image signal representing a third color; and generating a first output image signal representing the first color, a second output image signal representing the second color, and a third output image signal representing the third color, based on the first input image signal, the second input image signal, the third input image signal, and the white output image signal, wherein the generation of the white output image signal is performed by using a plurality of bit shifters.

The generation of the white output image signal may include the following steps: generating a weight function based on the first to third input image signals; converting the first, second, and third input image signals into first, second, and third weighted signals, respectively, based on the weight function; and producing the white output image signal based on the first, second, and third weighted signals, wherein the production of the white output image signal may be performed by using the plurality of bit shifters.

The production of the white output image signal may include the following steps: generating first, second, and third white candidate signals based on the first, second, and third weighted signals; and selecting one of the first, second, and third white candidate signals as the white output image signal, and wherein the generation of first, second, and third white candidate signals may include: generating the first white candidate signal by using the plurality of bit shifters.

The generation of the first white candidate signal may include the following steps: adding the first weighted signal a number of times as large as ten times a mixing proportion of the first color for obtaining a white color, the mixing proportion of the first color being greater than zero and smaller than one; adding the second weighted signal a number of times as large as ten times a mixing proportion of the second color for obtaining a white color, the mixing proportion of the second color being greater than zero and smaller than one; adding the third weighted signal a number of times as large as ten times a mixing proportion of the third color for obtaining a white color, the mixing proportion of the third color being greater than zero and smaller than one; adding results of the addition of the first weighted signal, the addition of the second weighted signal, and the addition of the third weighted signal; bit-shifting a result of the addition of results to generate a plurality of bit-shifted operation results, the plurality of bit-shifted operation results being bit-shifted by different digits; and adding the plurality of bit-shifted operation results to generate the first white candidate signal.

Each of the plurality of bit shifters may perform an operation corresponding to a term of a polynomial representing $1/(b\times10)$ in terms of $1/2^n$ where n is a natural number The natural number n may be equal to or smaller than a bit number of the first to third input image signals added by 1.

The generation of the weight function may include the following step:

performing de-gamma operation on the first to third input image signals. The method may further include: performing gamma operation on the first to third output image signals and the white output image signal.

One more embodiments of the invention may be related to a method of operating a display device. The method may include the following steps: using a first input signal, a second input signal, a third input signal, and a plurality of bit shifters to generate a first white-signal candidate, the first input signal pertaining to a first color, the second input signal pertaining to a second color, the third input signal pertaining to a third color, the plurality of bit shifters being implemented with hardware circuitry, the white-signal candidate pertaining to a white color; generating a white signal using the first white-signal candidate, the white signal pertaining to the white color; using the first input signal, the second input signal, the third input signal, and the white signal to generate a first output signal, a second image signal, a third output signal, and a fourth output signal, the first output signal pertaining to the first color, the second output signal pertaining to the second color, the third output signal pertaining to the third color, the fourth output signal pertaining to the white color; and providing the first output signal, the second output signal, the third output signal, and the fourth output signal to the display panel.

The method may further include the following steps: using a weight function, the first input signal or a first de-gamma signal pertaining to the first input signal, the second input signal or a second de-gamma signal pertaining to the second input signal, and the third input signal or a third de-gamma signal pertaining to the third input signal to generate a first weighted signal, a second weighted signal, and a third weighted signal; and calculating the first white-signal candidate using the first weighted signal, the second weighted signal, the third weighted signal, and the plurality of bit shifters.

The method may further include the following steps: generating a second white-signal candidate and a third white-signal candidate using the first weighted signal, the second weighted signal, and the third weighted signal; and selecting one of the first white-signal candidate, the second white-signal candidate, and the third white-signal candidate as the white signal.

The method may further include the following step: calculating an equivalent sum that is equal to a sum of a first term, a second term, and a third term and providing the equivalent sum to the plurality of bit shifters. The first term may be equal to ten times a value of the first weighted signal multiplied by a first multiplier. The second term may be equal to ten times a value of the second weighted signal multiplied by a second multiplier. The third term may be equal to ten times a value of the third weighted signal multiplied by a third multiplier. Each of the first multiplier, the second multiplier, and the third multiplier may be greater than 0 and smaller than 1. The sum of the first multiplier, the second multiplier, and the third multiplier may be equal to 1. The first multiplier, the second multiplier, and the third multiplier may be proportions for mixing the first color, the second color, and the third color to produce the white color.

The method may further include the following step: calculating the equivalent sum by adding one or more adding terms each being equal to the value of the first weighted signal, one or more adding terms each being equal to the value of the second weighted signal, and one or more adding terms each being equal to the value of the third weighted signal.

The method may further include the following steps: using each of the plurality of bit shifters to generate a shifted value by shifting a radix point of the equivalent sum by a number of digits such that a plurality of shifted values are generated; and calculating the first white-signal candidate by adding one or more positive values of one or more of the shifted values and one or more negative values of one or more of the shifted values.

The number of digits is equal to or smaller than a bit number of the first input signal plus 1.

The method may further include the following steps: performing de-gamma operation on the first input signal, the second input signal, and the third input image signal to generate the first de-gamma signal, the second de-gamma signal, and the third de-gamma signal; and performing gamma operation on a first pre-gamma signal, a second pre-gamma signal, a third pre-gamma signal, and a fourth pre-gamma signal to generate the first output signal, the third output signal, the fourth output signal.

One or more embodiments of the invention may be related to a signal converter for use in a display device. The signal converter may include the following elements: a first adder configured to generate a sum; a plurality of bit shifters configured to generate a plurality of shifted values, wherein each bit shifter of the plurality of bit shifters is configured to generate one of the shifted values by shifting a radix point of the sum by a number of digits; a second adder configured to calculate a first white-signal candidate by adding one or more positive values of one or more of the shifted values and one or more negative values of one or more of the shifted values performing at least one of adding one or more values of a first subset of the shifted values and subtracting one or more values of a second subset of the shifted values; and hardware circuitry for performing tasks associated with at least one of the first adder, the plurality of bit shifters, and the second adder.

In one or more embodiments, the first adder may be configured to generate the sum by adding a plurality of adding terms such that the sum is equal to a result of adding a first term, a second term, and a third term, the first term pertaining to a first color, the second term pertaining to a second color, the third term pertaining to a third color, the plurality of adding terms including more than three adding terms.

In one more embodiments, the sum may be related to a first input signal, the first input signal may pertain to a first color, and the number of digits may be equal to or smaller than a bit number of the first input signal.

In one or more embodiments, the second adder may be configured to perform both the adding and the subtracting.

DETAILED DESCRIPTION OF EMBODIMENTS OF THE INVENTION

Figure 1:
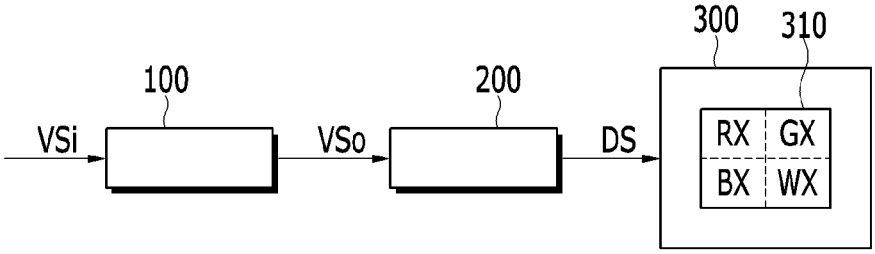
FIG. 1 is a block diagram illustrating a display device according to an embodiment of the present invention.

Aspects of the embodiments will be described more fully hereinafter with reference to the accompanying drawings. As those skilled in the art would realize, the described embodiments may be modified in various different ways, all without departing from the spirit or scope of the invention. In the drawing, parts having no relationship with the explanation may be omitted for clarity, and the same or similar reference numerals may designate the same or similar elements throughout the specification.

In the drawings, the thickness of layers, films, panels, regions, etc., may be exaggerated for clarity. Like reference numerals may designate like elements throughout the specification. It will be understood that when an element, such as a layer, film, region, or substrate, is referred to as being "on" another element, it can be directly on the other element or intervening elements may also be present between the two aforementioned elements. In contrast, when an element is referred to as being "directly on" another element, there are no intervening elements present between the two aforementioned elements.

Various embodiments are described herein below, including methods and techniques. It should be kept in mind that the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

Although the terms first, second, third etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer or section. Thus, a first signal, element, component, region, layer, or section discussed below may be termed a second signal, element, component, region, layer, or section without departing from the teachings of the present invention. The description of an element as "first" does not imply that second or other elements are needed. The terms first, second, third etc. may also be used herein to differentiate different categories of elements. For conciseness, the terms first, second, third, etc. may represent first-category, second-category, third-category, etc., respectively.

Figure 2:
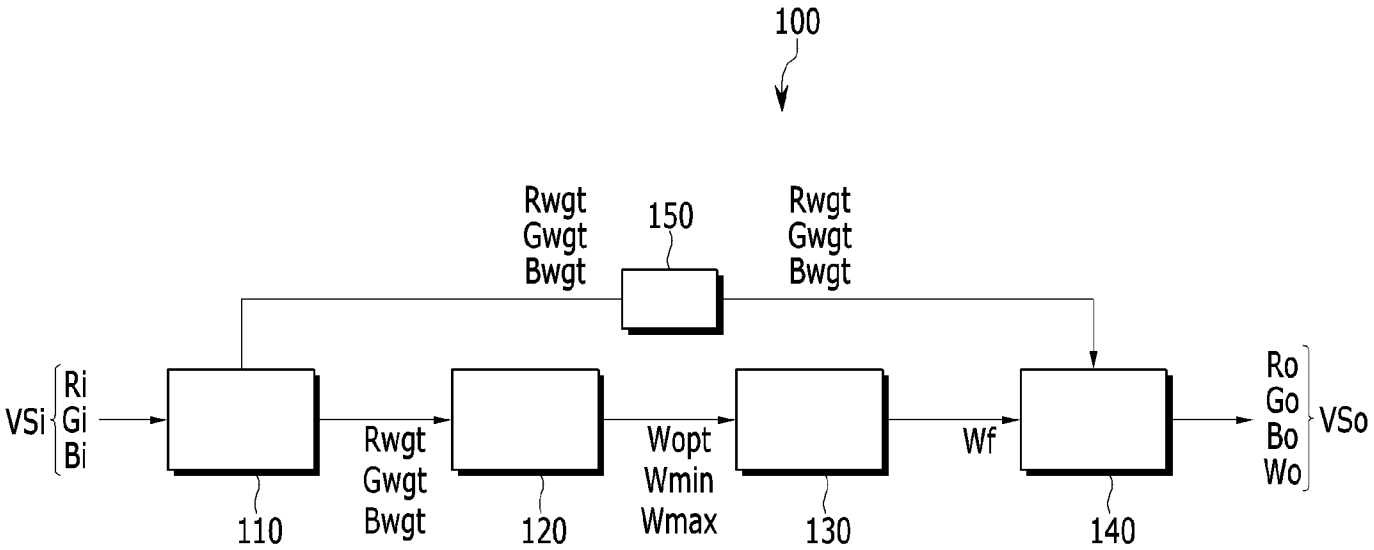
FIG. 2 is a block diagram illustrating a signal converter according to an embodiment of the present invention.
Figure 3:
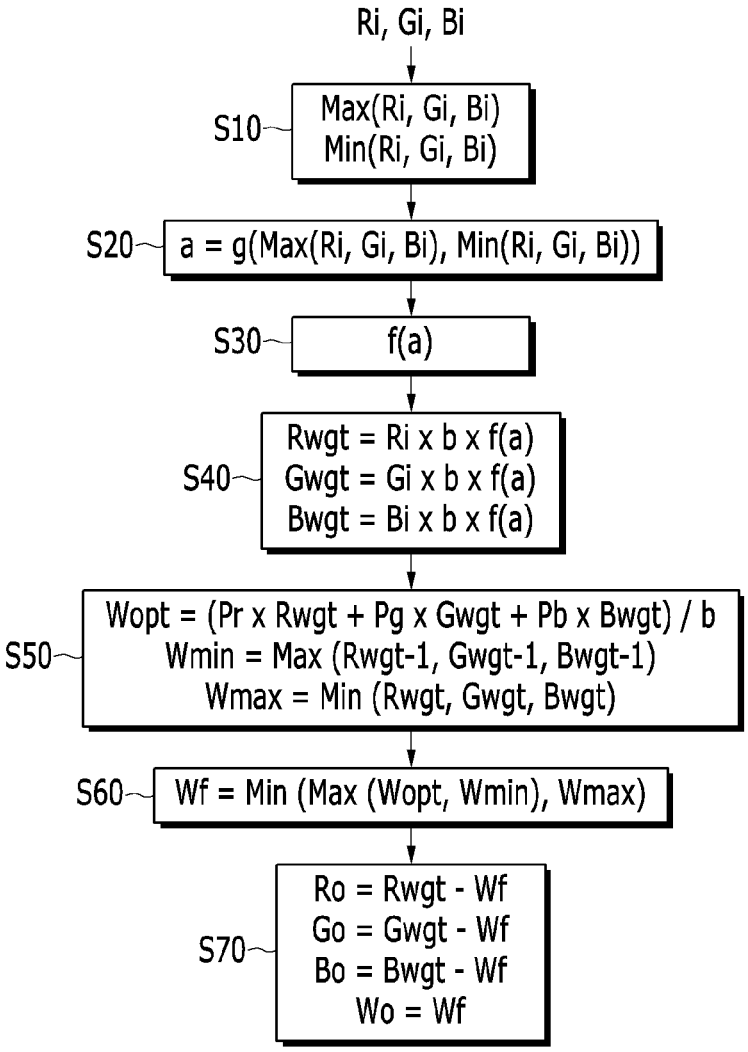
FIG. 3 is a flow diagram illustrating operation of the signal converter according to an embodiment of the present invention.
Figure 4:
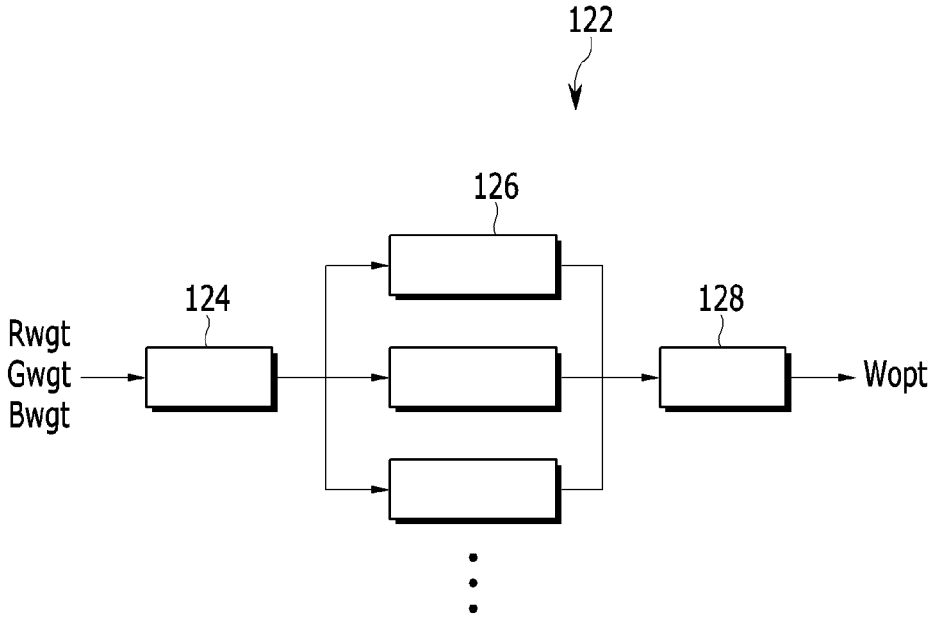
FIG. 4 is a block diagram illustrating a white signal candidate calculation unit according to an embodiment of the present invention.

FIG. 1 is a block diagram illustrating a display device according to an embodiment of the present invention. FIG. 2 is a block diagram illustrating a signal converter according to an embodiment of the present invention. FIG. 3 is a flow diagram illustrating operation of the signal converter according to an embodiment of the present invention. FIG. 4 is a block diagram illustrating a white signal candidate calculation unit according to an embodiment of the present invention.

Referring to FIG. 1, a display device according to an embodiment of the present invention includes a signal converter 100, a signal processor 200, and a display panel 300.

The display panel 300 includes a plurality of pixels 310 arranged substantially in a matrix. Each of the pixels 310 may represent one of white color and three primary colors. For example, the three primary colors may include red, green, and blue. As another example, the three primary colors may include cyan, magenta, and yellow. In FIG. 1, a white pixel is denoted by WX, a first-color pixel is denoted by RX, a second-color pixel is denoted by GX, and a third-color pixel is denoted by BX. In one or more embodiments, an arrangement of a four-color pixel set of the pixels 310 may be a two-by-two arrangement, as illustrated in FIG. 1. In one or more embodiments, a four-color pixel set of the pixels 310 may be arranged according to one of various forms, for example, a stripe arrangement or a PenTile® arrangement.

The signal converter 100 receives three-color input image signals VSi, and converts the three-color input images signals VSi into four-color output image signals VSo using a plurality of bit shifters (not shown). The signal processor 200 converts the output image signals VSo into data signals DS based on the arrangement of the pixels 310 in the display panel 300, and the display panel 300 coverts the data signals DS into images to be displayed thereon.

Referring to FIG. 2, the signal converter 100 according to an embodiment of the present invention includes a weighted-signal calculation unit 110, a white-signal candidate calculation unit 120, a white-signal selection unit 130, a four-color signal calculation unit 140, and a delay unit 150.

The weighted-signal calculation unit 110 receives three-color input image signals VSi, including a first-color input image signal Ri, a second-color input image signal Gi, and a third-color input image signal Bi, and assigns weights to respective input image signals Ri, Gi, and Bi, thereby generating first, second, and third weighted signals Rwgt, Gwgt, and Bwgt.

For example, the weighted signals Rwgt, Gwgt and Bwgt may be given by $$Rwgt=Ri\times b\times f(a),$$

$$Gwgt=Gi\times b\times f(a), \text{ and}$$

$$Bwgt=Bi\times b\times f(a), \quad \text{(Eq. 1)}$$

where b is a natural number.

A weight function f(a) may be defined in various ways. For example, the variable "a" may be a function of Max(Ri, Gi, Bi) and Min(Ri, Gi, Bi), i.e., a=g(Max(Ri, Gi, Bi), Min(Ri, Gi, Bi)). Here, Max(x, y, etc.) is defined as the greatest one (or the maximum value) of x, y, etc.; Min(x, y, . . . ) is defined as the smallest one (or the minimum value) of x, y, etc.; g(z, w) means a function of z and w.

According to one or more embodiments, f(a) may be defined as the following:

$$f(a)=1/[1+(a\times a)]; \quad \text{(Eq. 2)}$$

or $$f(a)=1/(1+a), \quad \text{(Eq. 3)}$$

where a=Max(0, Max(Ri, Gi, Bi)−[2×Min(Ri, Gi, Bi)]) in Eq. 2 and Eq. 3

According to one or more embodiments, f(a) may be defined as the following:

$$f(a)=1-0.5\times a\times a; \quad \text{(Eq. 4)}$$

or $$f(a)=1-0.5\times a, \quad \text{(Eq. 5)}$$

where a=Max(Ri, Gi, Bi)−Min(Ri, Gi, Bi) in Eq. 4 and Eq. 5.

Eq. 1 to Eq. 5 are examples of assigning weights to the input image signals VSi in one or more embodiments. In one or more embodiments, the weights may be determined in one or more other ways.

A process for obtaining the first, second, and third weighted signals Rwgt, Gwgt, and Bwgt using the first, second, and third input image signals Ri, Gi, and Bi performed by (and/or implemented in) the weighted signal calculation unit 110 is described with reference to FIG. 3. Max(Ri, Gi, Bi) and Min(Ri, Gi, Bi) are calculated using the first, second, and third input image signals Ri, Gi, and Bi (S10). Subsequently, a=g(Max(Ri, Gi, Bi), Min(Ri, Gi, Bi)) is calculated based on Max(Ri, Gi, Bi) and Min(Ri, Gi, Bi) (S20). As described above, "a" may be defined in various ways. For example, a=Max(Ri, Gi, Bi)−Min(Ri, Gi, Bi), and an adder (or a subtractor) may be used in the calculation of "a." Thereafter, a weight function f(a), which may be defined according to one of Eq. 2 to Eq. 5, is calculated based on "a" (S30). Subsequently, an operation according to Eq. 1 is performed to produce the first, second, and third weighted signals Rwgt, Gwgt, and Bwgt using the first, second, and third input image signals (Ri, Gi, and Bi) and the weight function f(a) (S40).

Referring to FIG. 2 and FIG. 3, the white-signal candidate calculation unit 120 calculates candidates for a white signal using the first, second, and third weighted signals Rwgt, Gwgt, and Bwgt (S50).

Examples of the candidates for a white signal include a first white-signal candidate Wopt, a second white-signal candidate Wmin, and a third white-signal candidate Wmax defined as follows:

$$Wopt=(Pr\times Rwgt+Pg\times Gwgt+Pb\times Bwgt)/b, \quad \text{(Eq. 6)}$$

$$Wmin=\mathrm{Max}(Rwgt-1,Gwgt-1,Bwgt-1), \text{ and} \quad \text{(Eq. 7)}$$

$$Wmax=\mathrm{Min}(Rwgt,Gwgt,Bwgt). \quad \text{(Eq. 8)}$$

In one or more embodiments, the multipliers Pr, Pg, and Pb multiplying the first, second, and third weighted signals Rwgt, Gwgt, and Bwgt for calculating the first white candidate signal Wopt may be mixing ratios of first, second, and third colors for obtaining a white color. The multipliers Pr, Pg, and Pb may satisfy a following condition:

$$Pr+Pg+Pb=1, \quad \text{(Eq. 9)}$$

where Pr>0, Pg>0, and Pb>0.

In one or more embodiments, the first, second, and third colors are red, green, and blue, respectively, and it may be determined that $$Pr=0.3,$$

$$Pg=0.6, \text{ and}$$

$$Pb=0.1. \quad \text{(Eq. 10)}$$

Since each of the multipliers Pr, Pg, and Pb is smaller than one, for convenience of calculation, Eq. 7 may be rewritten as:

$$Wopt=(10\times Pr\times Rwgt+10\times Pg\times Gwgt+10\times Pb\times Bwgt)/(b\times 10). \quad \text{(Eq. 11)}$$

Referring to FIG. 4, the white-signal candidate calculation unit 120 according to an embodiment includes a first white-signal candidate generator 122 that generates the first white candidate signal Wopt according to Eq. 11. The first white-signal candidate generator 122 includes a first adder 124, a set of bit shifters 126, and a second adder 128 that are connected in series.

The first adder 124 calculates Ex. 1, a portion of Eq. 11, as follows:

$$10\times Pr\times Rwgt+10\times Pg\times Gwgt+10\times Pb\times Bwgt \quad \text{(Ex. 1)}$$

For example, in one or more embodiments, the multipliers Pr, Pg, and Pb satisfy Eq. 10, and Ex. 1 may be $$3Rwgt+6Gwgt+1Bwgt, \quad \text{(Ex. 2)}$$

which may be equivalent to and may be represented by $$Rwgt+Rwgt+Rwgt+Gwgt+Gwgt+Gwgt+Gwgt+Gwgt+Gwgt+Bwgt, \quad \text{(Ex. 3)}$$

where Ex. 3 may be calculated solely by the first adder 124.

The bit shifters 126 and the second adder 128 perform a division by b×10 or a multiplication by 1/(b×10).

1/(b×10) may be expressed in a polynomial of $(1/2)^n$ or $1/2^n$ (where n is a natural number) having a plurality of terms. For example, in one or more embodiments, b is 2, and $$1/20=1/2^4-1/2^6+1/2^8-1/2^{10}+1/2^{12}-1/2^{14}+\ldots \quad \text{(Eq. 12)}$$

Since the multiplication of $1/2^n$ in a binary system is equivalent to an operation of shifting a radix point by n digits to the right, for obtaining the multiplication of 1/20, operations of shifting a radix point by four digits to the right, shifting the radix point by six digits to the right, shifting the radix point by eight digits to the right, shifting the radix point by ten digits to the right, and so on are performed in the plurality of bit shifters 126 (which are connected in parallel), respectively, and the results of the operations are added (and/or subtracted) in the second adder 128.

It is noted that the number of the bit shifters 126, that is, the number of terms in the polynomial of $1/2^n$, may be properly determined, for example, based on a bit number of each of the first, second, and third color input image signals Ri, Gi, and Bi.

According to an embodiment, the number of the bit shifters 126 may be equal to or smaller than (Nb+1), where the bit number of each of the input image signals Ri, Gi, and Bi is denoted by Nb.

In one or more embodiments, the number of digits shifted by each of the bit shifter 126 may be equal to or smaller than (Nb+1), i.e., n may be equal to or smaller than (Nb+1).

For example, in one or more embodiments, Nb=10, and Eq. 12 may be $$1/20\approx 1/2^4-1/2^6+1/2^8-1/2^{10}. \quad \text{(Eq. 13)}$$

Therefore, the number of the bit shifters 126 may be four, which is less than Nb+1, or 11. Each of values of n, i.e., 4, 6, 8, and 10, is less than 11.

Reducing the number of bit shifters 126 and/or reducing the number of digits shifted by the bit shifters 126 may simplify the structure of the first white white-signal candidate generator 122 (and the white-signal candidate calculation unit 120) and may accelerate the operation of the first white white-signal candidate generator 122 (and the white-signal candidate calculation unit 120).

Although the above-described operations performed by the bit shifters 126, which substitutes for an operation of a division, may produce an approximate value instead of an exact value, an error between the approximate value and the exact value may be allowable. For example, calculated errors for all possible cases of the ten-bit input image signals Ri, Gi, and Bi may be equal to or smaller than two gray scales, which may be ignorable since an allowable error is generally equal to or smaller than three gray scales.

As described above, the division by b×10 is performed using bit shifters in one or more embodiments. In comparison with a divider, the bit shifters involve a simpler structure and require less computation time. In comparison with a look up table, the bit shifters involve a simpler structure. Advantageously, embodiments of the invention may save manufacturing cost and/or may provide enhanced performance.

Referring to FIG. 2 and FIG. 3 again, the white-signal selection unit 130 selects one of the first, second, and third white-signal candidates Wopt, Wmin, and Wmin generated by the white-signal candidate calculation unit 120, and the white-signal selection unit 130 outputs the selected one as an optimal white signal Wf (S60). In general, the first white-signal candidate Wopt may be selected as the optimal white signal Wf. In one or more embodiments, when the first white-signal candidate Wopt is smaller than the second white-signal candidate Wmin, the second white-signal candidate signal Wmin, instead of the first white-signal candidate Wopt, may be determined as the optimal white signal Wf. In one or more embodiments, when the first white candidate signal Wopt is greater than the third white-signal candidate Wmax, the third white-signal candidate Wmax, instead of the first white-signal candidate Wopt, may be determined as the optimal white signal Wf. In one or more embodiments, the optimal white signal Wf is may be expressed as:

$$Wf=\mathrm{Min}(\mathrm{Max}(W\mathrm{opt},W\mathrm{min}),W\mathrm{max}). \quad \text{(Eq. 14)}$$

In one or more embodiments, the first white candidate signal Wopt may be always determined as the optimal white signal Wf without considering the second and third white candidate signals Wmin and Wmax.

The delay unit 150 delays the first, second, and third weighted signals Rwgt, Gwgt, and Bwgt calculated by the weighted signal calculation unit 110, and transmits the delayed signals to the four-color signal calculation unit 140, for example, in synchronization with the arrival of the optimal white signal Wf at the four-color signal calculation unit 140.

The four-color signal calculation unit 140 generates the output image signals VSo, which include the first, second, and third output image signals Ro (pertaining to the first color), Go (pertaining to the second color), and Bo (pertaining to the third color) and a fourth output image signal Wo (pertaining to the white color), using the first, second, and third weighted signals Rwgt, Gwgt, and Bwgt and the optimal white signal Wf (S70). For example, $$Ro=R\mathrm{wgt}-Wf,$$

$$Go=G\mathrm{wgt}-Wf,$$

$$Bo=B\mathrm{wgt}-Wf, \text{ and}$$

$$Wo=Wf. \quad \text{(Eq. 15)}$$

Figure 5:
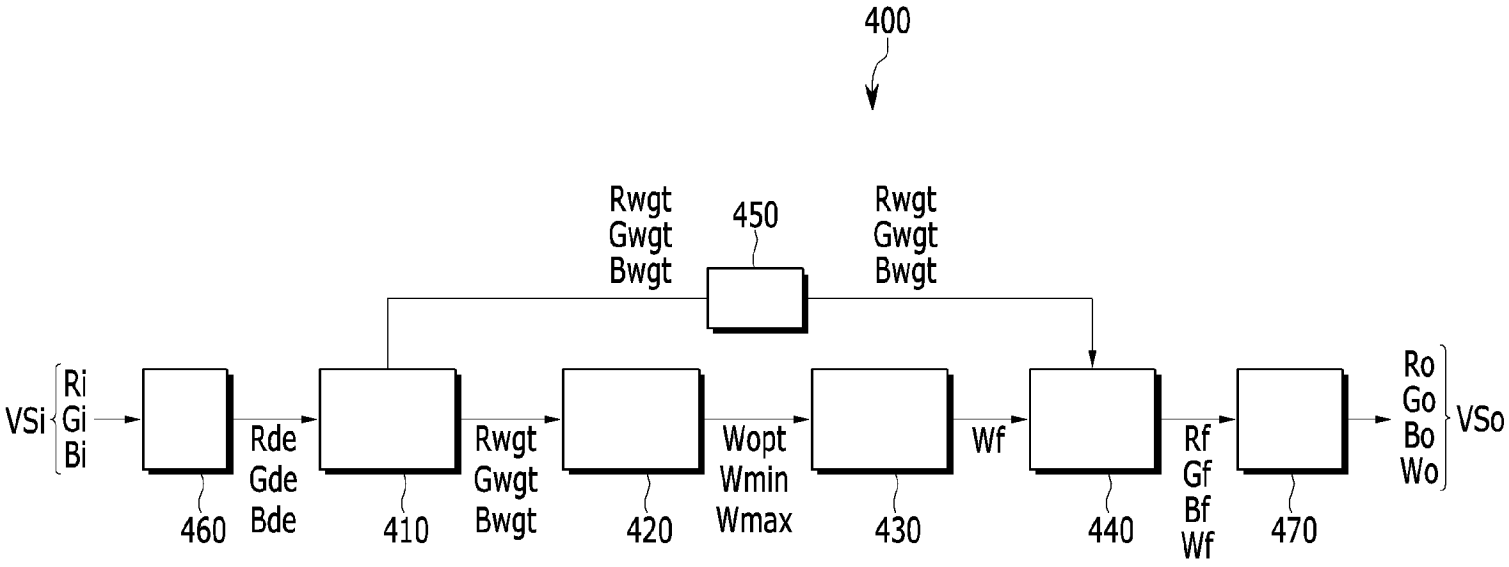
FIG. 5 is a block diagram illustrating a signal converter according to an embodiment of the present invention.

FIG. 5 is a block diagram illustrating a signal converter according to an embodiment of the present invention.

Referring to FIG. 5, a signal converter 400 according to an embodiment of the present invention includes a weighted-signal calculation unit 410, a white-signal candidate calculation unit 420, a white-signal selection unit 430, a four-color signal calculation unit 440, and a delay unit 450, analogous to the signal converter 100 shown in FIG. 2.

The signal converter 400 further includes a de-gamma unit 460 (which may be connected to an input terminal of the weighted-signal calculation unit 410) and a re-gamma unit 470 (which may be connected to an output terminal of the four-color signal calculation unit 440).

The de-gamma unit 460 converts input image signals Ri, Gi and Bi into a form suitable for operations of other units when the input image signals Ri, Gi, and Bi are gamma-corrected. (Hereinafter, the operation of the de-gamma unit 460 is referred to as "de-gamma.") For example, first, second, and third de-gamma signals Rde, Gde and Bde may be given by the following calculations:

$$Rde=(Ri)^r,$$

$$Gde=(Gi)^r, \text{ and}$$

$$Bde=(Bi)^r, \quad \text{(Eq. 16)}$$

where r is a gamma exponent.

According to one or more embodiments, the de-gamma signals Rde, Gde and Bde are inputted into the weighted-signal calculation unit 410, and the weighted-signal calculation unit 410 performs substantially the same operation as the weighted-signal calculation unit 110, using the de-gamma signals Rde, Gde, and Bde instead of the input image signals Ri, Gi, and Bi. The white-signal selection unit 430, the four-color signal calculation unit 440, and the delay unit 450 performs substantially the same operation(s) as the white-signal selection unit 130, the four-color signal calculation unit 140, and the delay unit 150, respectively. As illustrated in FIG. 4, output signals of the four-color signal calculation unit 440 are denoted by Rf, Gf, Bf, and Wf, which are referred to as pre-gamma output signals hereinafter.

The re-gamma unit 470 performs a gamma operation on the pre-gamma output signals Rf, Gf, Bf, and Wf (which are generated by the four-color signal calculation unit 440) to generate output image signals VSo, including first, second, and third output image signals Ro (pertaining to the first color), Go (pertaining to the second color), and Bo (pertaining to the third color) and a fourth output image signal Wo (pertaining to the white color).

The output image signals Ro, Go, Bo and Wo may be given by the following calculations:

$$Ro=(Rf)^{1/r},$$

$$Go=(Gf)^{1/r},$$

$$Bo=(Bf)^{1/r}, \text{ and}$$

$$Wo=(Wf)^{1/r}. \quad \text{(Eq. 17)}$$

Embodiments of the present invention may generate four-color image signals rapidly, simply, and inexpensively using bit shifters.

Figure 6:
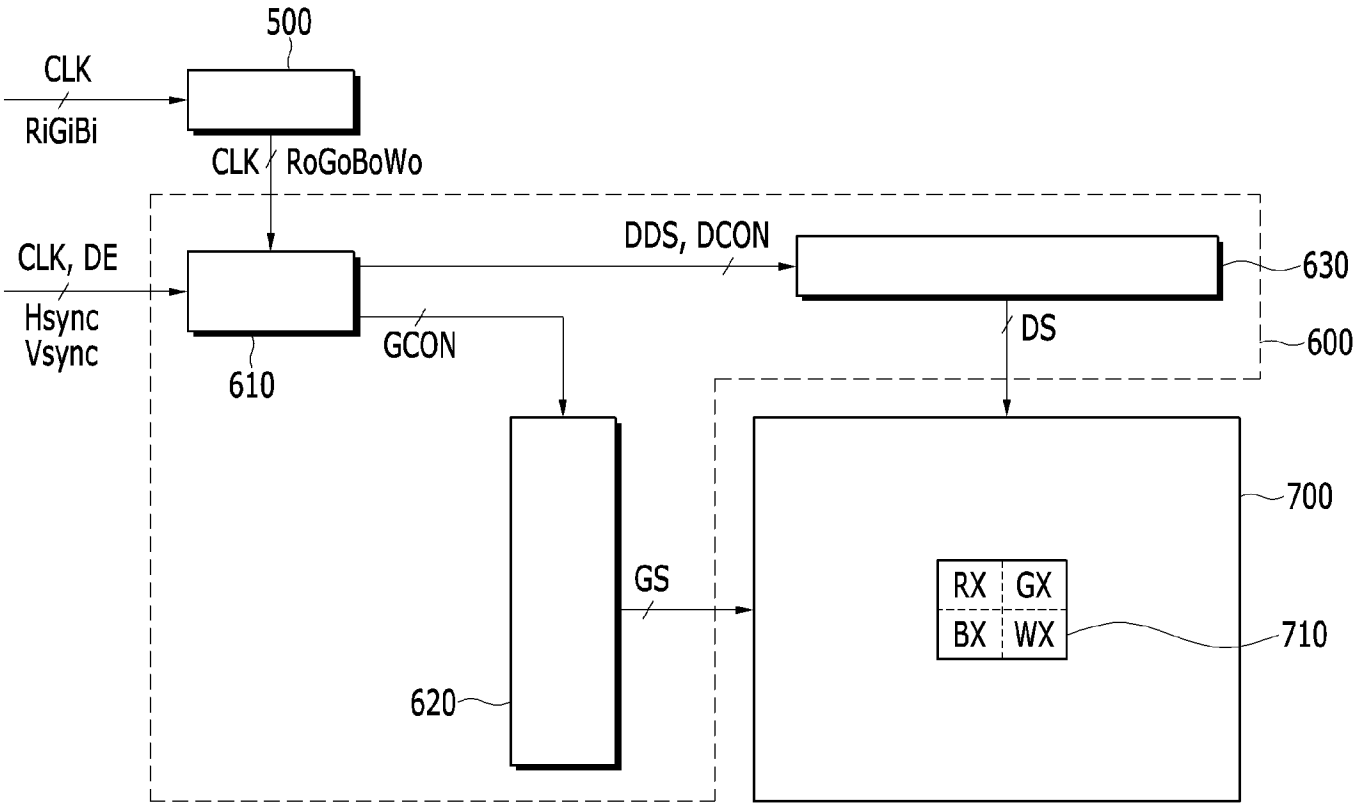
FIG. 6 is a block diagram illustrating a display device according to an embodiment of the present invention.
Figure 7:
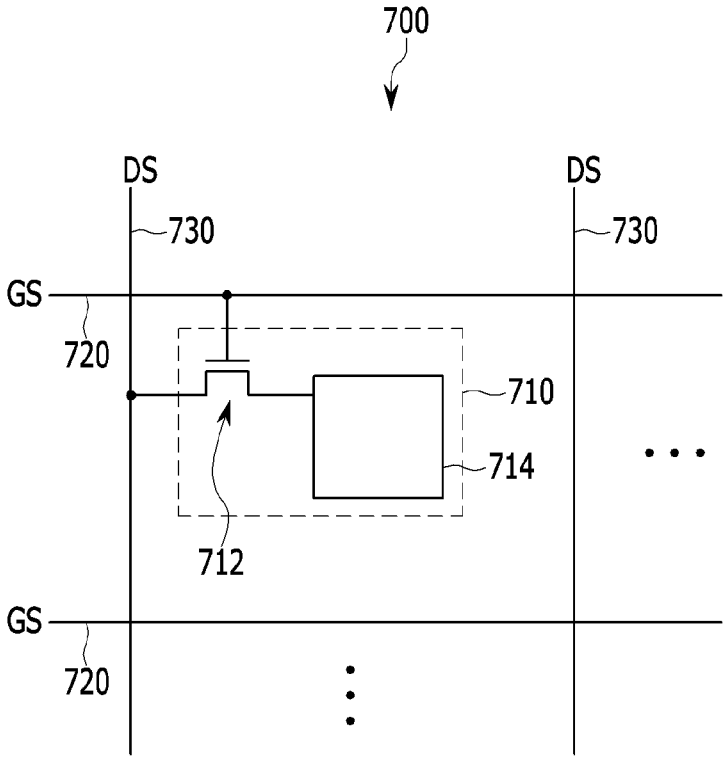
FIG. 7 is a schematic equivalent circuit diagram illustrating a display panel according to an embodiment of the present invention.

FIG. 6 is a block diagram illustrating a display device according to an embodiment of the present invention. FIG. 7 is a schematic equivalent circuit diagram illustrating a display panel according to an embodiment of the present invention.

Referring to FIG. 6, a display device according to an embodiment of the present invention includes a signal converter 500, a signal processor 600, and a display panel 700, like the display device shown in FIG. 1. The signal processor 600 includes a signal controller 610, a gate driver 620, and a data driver 620.

Referring to FIG. 6 and FIG. 7, the display panel 700 includes a plurality of pixels 710 and a plurality of signal lines 720 and 730 connected to the pixels 710.

Referring to FIG. 7, the plurality of signal lines 720 and 730 include a plurality of gate lines 720 that transmit gate signals GS and a plurality of data lines 730 that transmit data signals DS. The gate lines 720 are separated from each other and extend substantially parallel in a row direction. The data lines 730 are separated from each other and extend substantially parallel in a column direction.

Each of the pixels 710 includes a switching element 712 connected to one of the gate lines 720 and one of the data lines 730 and a display unit 714 connected to the switching element 712.

The switching element 712 may be a three-terminal device (such as a thin film transistor) and may have a control terminal, an input terminal, and an output terminal. The control terminal of the switching element 712 is connected to a gate line 720 to receive a gate signal GS, the input terminal is connected to a data line 730 to receive a data signal DS, and the output terminal is connected to the display unit 714. The switching element 712 may turn on or turn off in response to the gate signal GS to enable the display unit to be connected to or to be disconnected from the data line 730. The switching element 712 turns on to transmit the data signal DS to the display unit 714, and the switching element 712 turns off to block the data signal DS from being transmitted to the display unit 714.

The display unit 714 may display an image based on the data signal DS. The display unit 714 may have a structure depending on a type of the display device. The display unit 714 may include a liquid crystal layer for a liquid crystal display, an organic light emitting layer for an organic light emitting display, or polar and nonpolar liquids for an electrowetting display, for example.

The structure of a pixel 710 shown in FIG. 7 is merely an example thereof, and the pixel 710 may have a different structure.

Referring to FIG. 6, the gate driver 620 and the data driver 630 are connected to the display panel 700. The gate driver 620 is connected to the display panel 700 through the gate lines 720 and may apply the gate signals GS (illustrated in FIG. 7) to the gate lines 720, which turn on or turn off the switching elements 712. The data driver 630 is connected to the display panel 700 through the data lines 730 and may apply the data signals DS representing images to the data lines 730.

The signal controller 610 is connected to the signal converter 500, the gate driver 620, and the data driver 630 and controls the gate driver 620 and the data driver 630.

The signal converter 500 receives three-color input image signals Ri, Gi, and Bi and converts the three-color input image signals Ri, Gi, and Bi into four-color output image signals Ro, Go, Bo, and Wo to be supplied for the signal controller 610. The signal converter 500 may have one or more structures substantially the same as one or more of structures discussed with reference to FIG. 2, FIG. 4, and FIG. 5.

The signal converter 500 receives three-color input image signals Ri, Gi, and Bi and a clock signal CLK from an external device. The signal converter 500 generates four-color output image signals Ro, Go, Bo, and Wo according to one or more of the steps described with reference to FIG. 1 to FIG. 5 and provides the four color output image signals Ro, Go, Bo, and Wo as well as the clock signal CLK to the signal controller 610.

The signal controller 610 receives the four-color output image signals Ro, Go, Bo, and Wo and the clock signal CLK from the signal converter 500 and receives input control signals (for controlling the display using the input image signals Ri, Gi and Bi) from the external device. Examples of the input control signals may include a vertical synchronization signal Vsync, a horizontal synchronization signal Hsync, the clock signal CLK, a data enable signal DE, and so on.

Based on the input control signals, the signal controller 610 generates gate control signals GCON for controlling the gate driver 620 and generates data control signals DCON for controlling the data driver 630. In addition, the signal controller 610 processes the output image signals Ro, Go, Bo, and Wo (received from the signal controller 600) to generate digital data signals DDS suitable for the display panel 700. Thereafter, the signal controller 610 outputs the gate control signals GCON to the gate driver 620 and outputs the data control signals DCON and the digital data signals DDS to the data driver 630.

Based on the data control signals DCON from the signal controller 610, the data driver 630 converts the digital data signals DDS into analog data signals DS to be applied to the data lines 730. The gate driver 620 generates gate signals GS and applies the gate signals GS to the gate lines 720 based on the gate control signals GCON received from the signal controller 610.

The switching elements 712 of the pixels 710 connected to the gate lines 720 turn on or turn off in response to the gate signals GS, and the display units 714 receive the data signals DS through the turned-on switching elements 712 and display images corresponding to the data signals DS.

While this invention has been described in connection with what is presently considered to be practical exemplary embodiments, it is to be understood that the invention is not limited to the disclosed embodiments. The invention is intended to cover various modifications and equivalent arrangements included within the spirit and scope of the appended claims.

What is claimed is:

1. A display device comprising:

a display panel comprising a plurality of pixels configured for displaying a first color, a second color, a third color, and a white color;

a signal converter configured to generate a set of output signals, which includes a first output signal pertaining to the first color, a second output signal pertaining to the second color, a third output signal pertaining to the third color, and a fourth output signal pertaining to the white color, using a set of input image signals, which includes a first input signal pertaining to the first color, a second input signal pertaining to the second color, and a third input signal pertaining to the third color; and a signal processor configured to process the output signals to generate data signals and to provide the data signals to the display panel, thereby causing the pixels to display an image using the data signals, wherein the signal converter comprises at least one adder and a plurality of bit shifters configured to calculate a first white-signal candidate using signals related to the first input signal, the second input signal, and the third input signal, wherein the signal converter is configured to determine the fourth output signal using the first white-signal candidate, and wherein the signal converter comprises:

a weighted-signal calculation unit configured to assign respective weights to the first input signal or a first de-gamma signal pertaining to the first input signal, the second input signal or a second de-gamma signal pertaining to the second input signal, and the third input signal or a third de-gamma signal pertaining to the third input signal to generate a first weighted signal, a second weighted signal, and a third weighted signal, respectively;

a white-signal candidate calculation unit configured to generate the first white-signal candidate, a second white-signal candidate, and a third white-signal candidate using a first copy of the first weighted signal, a first copy of the second weighted signal, and a first copy of the third weighted signal, the white-signal candidate calculation unit comprising the plurality of bit shifters;

a white-signal selection unit configured to select one of the first white-signal candidate, the second white-signal candidate, and the third white-signal candidate as an optimal white signal;

a four-color signal calculation unit configured to generate the first output signal or a first pre-gamma signal, the second output signal or a second pre-gamma signal, the third output signal or a third pre-gamma signal, and the fourth output signal or a fourth pre-gamma signal using a delayed copy of the first weighted signal, a delayed copy of the second weighted signal, a delayed copy of the third weighted signal, and the optimal white signal; and a delay unit configured to delay a second copy of the first weighted signal, a second copy of the second weighted signal, and a second copy of the third weighted signal and to output the delayed copy of the first weighted signal, the delayed copy of the second weighted signal, and the delayed copy of the third weighted signal to the four-color signal calculation unit.

2. The display device of claim 1, wherein one of the pixels comprises a switching element configured to turn on or to turn off based on a gate signal to transmit or not to transmit one of the data signals, wherein the signal processor comprises:

a gate driver configured to provide the switching element with the gate signal;

a data driver configured to provide the switching element with the one of the data signals; and a signal controller configured to control the gate driver and the data driver, to process the output image signals for generating processed image signals, and to output the processed image signals to the data driver, and wherein the data driver converts the processed output image signals into the data signals.

3. The display device of claim 1, wherein the white-signal candidate calculation unit comprises:

a first adder configured to calculated an equivalent sum that is equal to a sum of a first term, a second term, and a third term and configured to provide the equivalent sum to the plurality of bit shifters, the first term being equal to ten times a value of the first weighted signal multiplied by a first multiplier, the second term being equal to ten times a value of the second weighted signal multiplied by a second multiplier, the third term being equal to ten times a value of the third weighted signal multiplied by a third multiplier, each of the first multiplier, the second multiplier, and the third multiplier being greater than zero and smaller than 1, a sum of the first multiplier, the second multiplier, and the third multiplier being equal to 1, the first multiplier, the second multiplier, and the third multiplier being proportions for mixing the first color, the second color, and the third color to produce the white color; and a second adder configured to perform at least one of adding and subtracting outputs of the plurality of bit shifters to generate the first white-signal candidate.

4. The display device of claim 3, wherein the first adder is configured to calculate the equivalent sum by adding one or more adding terms each being equal to the value of the first weighted signal, one or more adding terms each being equal to the value of the second weighted signal, and one or more adding terms each being equal to the value of the third weighted signal, and the plurality of bit shifters and the second adder are configured to perform an operation that approximates a mathematical division operation.

5. The display device of claim 4, wherein each of the plurality of bit shifters is configured to generate a shifted value by shifting a radix point of the equivalent sum by a number of digits such that the plurality of bit shifters is configured to generate a plurality of shifted values, and wherein the second adder is configured to calculate the first white-signal candidate by performing at least one of adding one or more values of a first subset of the shifted values and subtracting one or more values of a second subset of the shifted values.

6. The display device of claim 5, wherein the number of digits is equal to or smaller than a sum of a bit number of the first input signal and 1.

7. The display device of claim 5, wherein the signal converter further comprises:

a de-gamma unit configured to perform one or more de-gamma operations on the first input signal, the second input signal, and the third input signal to generate the first de-gamma signal, the second de-gamma signal, and the third de-gamma signal; and a re-gamma unit configured to perform a gamma operation on the first pre-gamma signal, the second pre-gamma signal, the third pre-gamma signal, and the fourth pre-gamma signal for generating the first output signal, the second output signal, the third output signal, and the fourth output signal.

8. A method of operating a display device, the display device including a display panel, the method comprising:

using a first input signal, a second input signal, a third input signal, and a plurality of bit shifters to generate a first white-signal candidate, the first input signal pertaining to a first color, the second input signal pertaining to a second color, the third input signal pertaining to a third color, the plurality of bit shifters being implemented with hardware circuitry, the white-signal candidate pertaining to a white color;

generating a white signal using the first white-signal candidate, the white signal pertaining to the white color;

using the first input signal, the second input signal, the third input signal, and the white signal to generate a first output signal, a second output signal, a third output signal, and a fourth output signal, the first output signal pertaining to the first color, the second output signal pertaining to the second color, the third output signal pertaining to the third color, the fourth output signal pertaining to the white color; and providing the first output signal, the second output signal, the third output signal, and the fourth output signal to the display panel, wherein generating the first white-signal candidate includes:

using a weight function, the first input signal or a first de-gamma signal pertaining to the first input signal, the second input signal or a second de-gamma signal pertaining to the second input signal, and the third input signal or a third de-gamma signal pertaining to the third input signal to generate a first weighted signal, a second weighted signal, and a third weighted signal, respectively; and calculating the first white-signal candidate using the first weighted signal, the second weighted signal, the third weighted signal, and the plurality of bit shifters.

9. The method of claim 8, further comprising:

generating a second white-signal candidate and a third white-signal candidate using the first weighted signal, the second weighted signal, and the third weighted signal; and selecting one of the first white-signal candidate, the second white-signal candidate, and the third white-signal candidate as the white signal.

10. The method of claim 9, further comprising calculating an equivalent sum that is equal to a sum of a first term, a second term, and a third term and providing the equivalent sum to the plurality of bit shifters, the first term being equal to ten times a value of the first weighted signal multiplied by a first multiplier, the second term being equal to ten times a value of the second weighted signal multiplied by a second multiplier, the third term being equal to ten times a value of the third weighted signal multiplied by a third multiplier, each of the first multiplier, the second multiplier, and the third multiplier being greater than 0 and smaller than 1, a sum of the first multiplier, the second multiplier, and the third multiplier being equal to 1, the first multiplier, the second multiplier, and the third multiplier being proportions for mixing the first color, the second color, and the third color to produce the white color; and calculating the equivalent sum by adding one or more adding terms each being equal to the value of the first weighted signal, one or more adding terms each being equal to the value of the second weighted signal, and one or more adding terms each being equal to the value of the third weighted signal.

11. The method of claim 10, further comprising:

using each of the plurality of bit shifters to generate a shifted value by shifting a radix point of the equivalent sum by a number of digits such that a plurality of shifted values are generated; and calculating the first white-signal candidate by adding one or more positive values of one or more of the shifted values and one or more negative values of one or more of the shifted values.

12. The method of claim 11, wherein the number of digits is equal to or smaller than a sum of a bit number of the first input signal and 1.

13. The method of claim 8, further comprising:

performing de-gamma operation on the first input signal, the second input signal, and the third input image signal to generate the first de-gamma signal, the second de-gamma signal, and the third de-gamma signal; and performing gamma operation on a first pre-gamma signal, a second pre-gamma signal, a third pre-gamma signal, and a fourth pre-gamma signal to generate the first output signal, the third output signal, the fourth output signal.

14. A signal converter for use in a display device, the signal converter comprising:

a first adder configured to generate a sum;

a plurality of bit shifters configured to generate a plurality of shifted values, wherein each bit shifter of the plurality of bit shifters is configured to generate one of the shifted values by shifting a radix point of the sum by a number of digits;

a second adder configured to calculate a first white-signal candidate by adding one or more positive values of one or more of the shifted values and one or more negative values of one or more of the shifted values performing at least one of adding one or more values of a first subset of the shifted values and subtracting one or more values of a second subset of the shifted values; and hardware circuitry for performing tasks associated with at least one of the first adder, the plurality of bit shifters, and the second adder.

15. The signal converter of claim 14, wherein the first adder is configured to generate the sum by adding a plurality of adding terms such that the sum is equal to a result of adding a first term, a second term, and a third term, the first term pertaining to a first color, the second term pertaining to a second color, the third term pertaining to a third color, the plurality of adding terms including more than three adding terms.

16. The signal converter of claim 14, wherein the sum is related to a first input signal, wherein the first input signal pertains to a first color, and wherein the number of digits is equal to or smaller than a sum of a bit number of the first input signal and 1.

17. The signal converter of claim 14, wherein the second adder is configured to perform both the adding and the subtracting.

* * * * *